United States Patent [19]

Presser

[11] 4,374,638

[45] Feb. 22, 1983

[54] WATER SKI HANDLE AND TOW ROPE ARRANGEMENT

[76] Inventor: Dwight W. Presser, P.O. Box 5264, W. Bloomfield Twp., Oakland County, Mich. 48033

[21] Appl. No.: 211,271

[22] Filed: Nov. 28, 1980

[51] Int. Cl.[3] ..... A63C 15/06

[52] U.S. Cl. ..... 441/69

[58] Field of Search ..... 24/115 R, 115 K, 115 G, 24/115 H, 130, 136 R, 136 K, 121, 134 R; 9/310 R, 310 A; 114/253; 441/69; 272/61, 62

[56] References Cited

U.S. PATENT DOCUMENTS

| | | | |
|---|---|---|---|
| 1,380,800 | 6/1921 | Haworth | 24/115 R |
| 2,869,872 | 1/1959 | Nissen | 24/115 |
| 3,092,068 | 6/1963 | Brownson | 9/310 A |
| 3,695,210 | 10/1972 | Stein | 9/310 A |
| 4,043,290 | 8/1977 | Holland | 9/310 A |

*Primary Examiner*—Galen L. Barefoot
*Assistant Examiner*—Jesús D. Sotelo
*Attorney, Agent, or Firm*—Barnes, Kisselle, Raisch, Choate, Whittemore & Hulbert

[57] ABSTRACT

A ski tow arrangement for water skiing comprising an elongated handle having a pair of transverse openings and a tow line having free ends terminating in a loop extending into each of the openings. A flat T-shaped retainer is engaged by each of the loops and includes a central portion extending into the handle with laterally projecting barbs engaging opposing wall surfaces of the handle openings for resisting removal. The head portions of the T-shaped retainers abut an external rearward edge of the handle. The handle itself comprises a wooden core into which the retainer barbs are embedded, an aluminum sleeve surrounding the core and a casing of resilient friction material molded over the core. A pair of sleeves are formed integrally with the casing and project forwardly of the handle coaxially with the core openings for embracing the tow line and protecting a skier's hands from abrasion thereagainst.

8 Claims, 6 Drawing Figures

WATER SKI HANDLE AND TOW ROPE ARRANGEMENT

The present invention relates to tow ropes, and particularly to a handle and tow rope arrangement adapted for use in water skiing or the like.

Typical prior art water ski handles and tow rope arrangements are shown in the following U.S. Pat. Nos.: Brownson 3,092,068 and 3,537,418, Stein 3,695,210, Beck 3,930,460, Holland 4,043,290 and Presser 4,182,258.

It is a general object of the present invention to provide a handle and rope arrangement which is economical to manufacture and assemble, which is compact and neat in appearance, which is rugged and durable in operation, and which is particularly well adapted for use in water skiing or the like.

A more specific object of the invention is to provide a water ski handle and tow rope arrangement of the above-described type which is adapted to rest comfortably in a skier's hand and which protects the skier's hand against chafing or entanglement with the tow line.

A further and yet more specific object of the invention is to provide an improved, economical, inconspicuous and reliable arrangement for attaching the tow rope to the handle.

Yet another specific object of the invention is to provide such an attachment arrangement which is self-tightening in use when towing a skier, and which resists disassembly or detachment of the handle from the tow rope when the tow rope is slack and the handle is pulled through the water.

The invention, together with additional objects, features and advantages thereof, will be best understood from the following description, the appended claims and the accompanying drawing in which:

Figure 1:
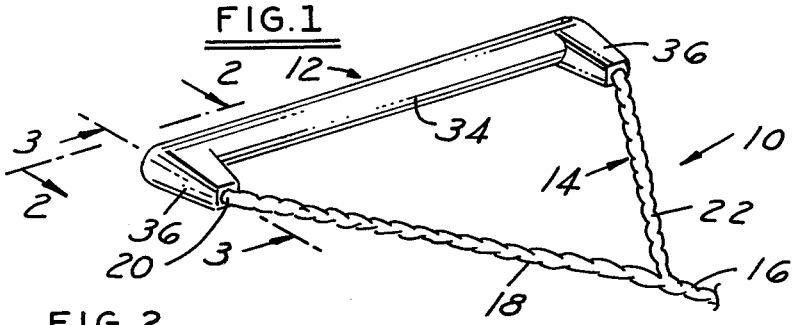
FIG. 1 is a perspective view of a presently preferred embodiment of the handle and tow rope arrangement in accordance with the invention.

Referring to FIGS. 1–4, a ski tow arrangement 10 in accordance with a presently preferred embodiment of the invention comprises a handle 12 bridging and connected to a Y-shaped tow line or bridle 14 which has an extended free end 16 for connection to a ski tow boat or the like (not shown). Tow line 14 preferably comprises an extended integral length 18 of conventional hollow braided flexible thermoplastic material such as nylon connected at one end 20 to handle 12, and a shorter length 22 of similar material connected at one end to handle 12 and attached at the other end to length 18 to form the above-mentioned Y-shaped bridle configuration. It will be understood that the arrangement for connecting tow line segment 22 to handle 12 is identified in all respects to the arrangement for so connecting segment 18, the latter being shown in the drawing and described in detail hereinafter.

Handle 12 comprises a cylindrical solid core 24 (FIG. 3) of rigid buoyant construction and a casing 26 of resilient friction material molded as one piece over core 24. Core 24 includes a solid cylindrical section 28 of wooden dowel material such as hard maple received by press fit into a thin-walled sleeve 30 of light weight non-corrosive metal such as aluminum. A pair of cylindrical openings 32 (FIG. 3) extend on parallel axes transversely through core 24 adjacent the axial ends thereof for receiving tow line 14 in the manner to be described. Casing 26 comprises a layer of material molded over and encompassing core 24 in predetermined cross sectional configuration to form a central hand grip 34. In the particular embodiment illustrated in the drawing, hand grip 34 is of generally ovate cross section transversely of handle 12, with the edge of lesser diameter being directed forwardly of the handle. (It will be understood that directional adjectives such as "forward" and "rearward" are taken with reference to preferred orientation of the handle in use with the "forward" edge being directed in the pulling direction toward the tow boat, for example, at the "rearward" edge facing the skier.) Casing 26 also includes a pair of sleeves 36 molded integrally with hand grip 34 and projecting from the forward edge of handle 12 coaxially with core openings 32. A central opening 38 in each sleeve 36 extends cocylindrically with corresponding core openings 32 for receiving the tow line.

In accordance with the present invention, tow rope arrangement 10 further includes a pair of retainers 40 disposed one in each of the longitudinally spaced core openings 32 for retaining therein the corresponding end of tow rope 14. More specifically and referring in particular to FIGS. 2–4, the end 20 of tow rope segment 18 terminates within handle 12 in a closed loop 42 formed (as best seen in FIG. 4) by interweaving the free end 44 of the tow rope section into the side wall of the hollow rope braid and then feeding end 44 internally toward the forward rope end. Each retainer 40 comprises a flat generally T-shaped element of extruded and sheared aluminum disposed within the corresponding loop 42. Retainer 40 includes a central leg portion 46 projecting into and terminating in assembly within core opening 32 (FIG. 3), and a head portion 48 having a pair of wings 50,52 extending radially from core opening 32 and cooperating with core 24 for preventing removal of the retainer in the pulling direction of rope 14.

Figure 2:
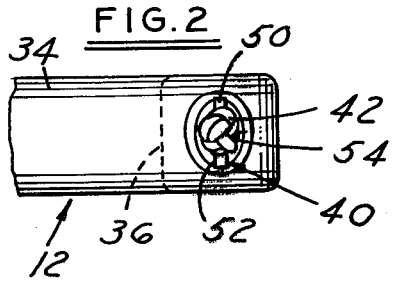
FIG. 2 is a fragmentary elevational view of the tow handle arrangement taken along the line 2—2 in FIG. 1.
Figure 3:
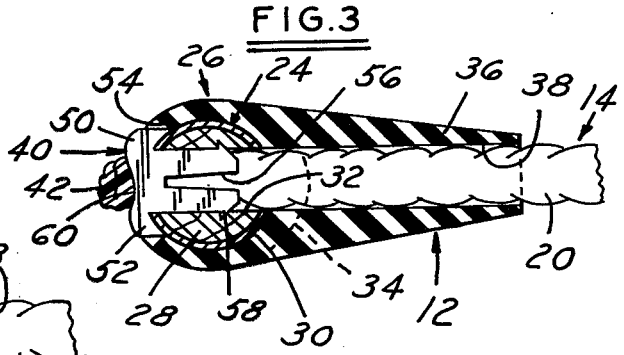
FIG. 3 is a sectional view taken along the line 3—3 in FIG. 1.
Figure 4:
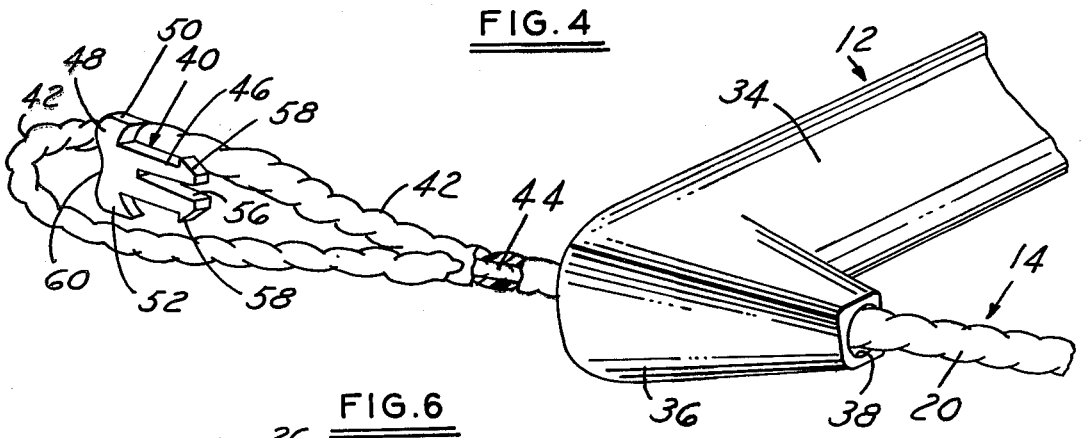
FIG. 4 is a fragmentary exploded perspective view of the preferred embodiment.

As best seen in FIGS. 2 and 3, wings 50,52 have arcuate under surfaces formed on a common cylinder of revolution for flush engagement with the cylindrical outer surface of aluminum sleeve 30. The pockets 54 (FIGS. 2 and 3) are molded into the rearward edge of casing 26 surrounding each opening 32 for receiving head portions 48 of retainers 40 such that the under surface of wings 50,52 engage core 24 as described rather than the material of casing 26. Retainer leg portion 46 is centrally split as at 56 for resiliency during assembly, and has a pair of opposed rearwardly angulated barbs 58 projecting laterally outwardly into the wooden dowel portion 28 of core 24 for resisting removal of retainer 40 in the rearward direction due to water pressure when the rope and handle are drawn through the water behind a boat, i.e. when the rope is slack. The outer surface of retainer head portion 48 is dished at 60 for receiving the looped end 42 of the tow rope.

In assembly, the free end 20 of tow rope 14 is first fed from the forward to rearward direction through opening 38 in sleeve 36 and opening 32 in core 24. At the rearward edge of the hand grip 12, the tow rope end is then looped upon itself and interwoven into itself as previously described and as shown in FIG. 4. The retaining element 40 is then positioned by hand as shown in FIG. 4 and the tow rope is pulled in the forward direction until the retainer is in the fully assembled position as shown in FIG. 3. It will be appreciated that the hollow braided construction of tow rope 14 cooperates with the retainer construction and assembly arrangement hereinabove described to render the attachment between the tow rope and hand grip self-tightening in operation when a pulling force is exerted on the handle. Additionally, and as indicated above, barbs 58 cooperate with the opposing surface of opening 32 in core 24 for resisting removal in the rearward direction when the line is slack and water under pressure enters sleeve opening 38 as the handle is pulled through the water by a boat.

Figure 5:
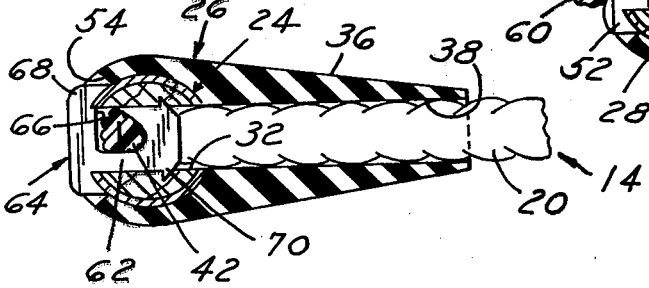
FIGS. 5 and 6 are sectional views similar to FIG. 3 illustrating respective modified embodiments of the invention.
Figure 6:
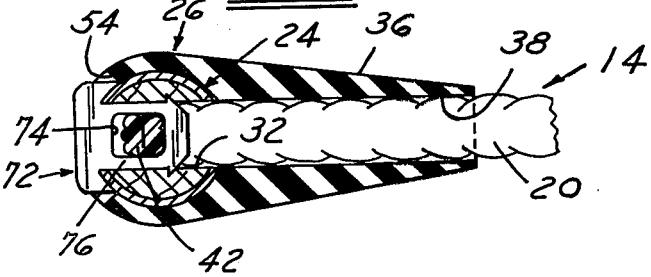

FIG. 5 illustrates a modified embodiment of the invention wherein the central leg portion 62 of the retainer 64 has an opening 66 communicating with one retainer side edge between head portion 68 and barbs 70 for receiving tow line loop 42 in assembly. FIG. 6 illustrates a second modified retainer 72 which has an opening 74 bounded by leg portion 76 and through which line end 20 is fed in assembly prior to formation of loop 42. Each of the modified embodiments of FIGS. 5 and 6 have the advantage that the line end loop 42 is protectively enclosed within handle 12. Structure and assembly of the embodiments of FIGS. 5 and 6 are otherwise identical to FIGS. 1–4.

In the presently preferred embodiments of the invention shown in the drawing, sleeves 36 are illustrated as having a substantially square cross section transversely of sleeve openings 38. However, the contour of the sleeves may be altered for ornamental purposes while still protecting the skier's hand from entanglement with or abrasion against the tow rope, and without departing from the scope of the invention. It will also be appreciated that sleeves 36 may be formed separately of casing hand grip section 34 as core end caps. Such end caps will be held in assembly with the core and casing by the tow rope retainers 40, 64 or 72. However, integral casing construction of sleeves 36 with hand grip section 34 as hereinabove described is preferred. The hand grip section 34 of handle 12 is illustrated as ovate in the drawing. However, the hand grip may be of other cross sectional configurations, such as triangular as in the above-noted Presser patent, without departing from the scope of the invention.

The invention claimed is:

1. A ski tow arrangement for water skiing comprising an elongated handle having a handle axis, at least one opening extending through said handle transversely of said axis from a forward edge of said handle to a rearward edge and a surface pocket at said rearward edge continuously adjacent to said opening, a tow line of hollow braided construction terminating in a free end interwoven into itself to form a self-tightening closed loop extending into said opening from said forward edge to said rearward edge, and a T-shaped retainer element of flat planar construction having uniform thickness disposed within said loop and comprising a central leg portion extending into said opening and a head portion with a pair of wings coplanar with said leg portion received in said pocket externally of said opening and projecting oppositely transversely of said axis within said pocket for holding said retainer element in an orientation perpendicular to said axis and preventing removal of said loop forwardly through said opening.

2. The ski tow arrangement set forth in claim 1 wherein said handle has a surface of curvature at said rearward edge on an axis parallel to said handle axis, and wherein said wings respectively oppositely project in the direction of said surface of curvature and have under surfaces at an acute angle with respect to said central leg portion in abutment with said handle within said pocket.

3. The ski tow arrangement set forth in claim 2 wherein said handle comprises a core of buoyant rigid construction and a casing of resilient friction material molded onto said core, said pocket being formed in said casing.

4. The ski tow arrangement set forth in claim 1, 2 or 3 wherein said central leg portion of said retainer element includes means for receiving and retaining said closed loop internally of said handle, said last-named means including a slot opening at an edge of said retainer element for receiving a preformed said closed loop.

5. The ski tow arrangement set forth in claim 1, 2 or 3 wherein said central leg portion includes a pair of barbs projecting laterally oppositely of said leg portion and engaging said core within said opening.

6. The ski tow arrangement set forth in claim 1, 2 or 3 wherein said closed loop engages said head portion of said retainer externally of said rearward edge of said handle.

7. The ski tow arrangement set forth in claim 3 wherein said handle includes parallel openings extending transversely through each end of said handle, wherein said tow line comprises a bridle having ends terminating in said loops extending into each of said parallel openings, and wherein said arrangement comprises a said retainer element disposed in each said opening attaching each of said bridle ends to said handle.

8. The ski tow arrangement set forth in claim 7 wherein said handle further comprises a pair of sleeves integral with said casing projecting from said forward edge coaxially with respective ones of said openings and encompassing said bridle ends.

* * * * *